United States Patent [19]

Cooke

[11] 4,010,501

[45] Mar. 8, 1977

[54] TWO-PIECE BUCKLE AND ITS USE ON BODY-BUOYING EQUIPMENT

[75] Inventor: Lawrence G. Cooke, Ashland, Ohio

[73] Assignee: Eagle Rubber Co., Inc., Ashland, Ohio

[22] Filed: Sept. 2, 1975

[21] Appl. No.: 609,273

[52] U.S. Cl. ..... 9/338; 24/201 HE; 24/226; 403/353; 248/223

[51] Int. Cl.[2] ..... A44B 13/00; B63C 9/08

[58] Field of Search ... 24/201 HE, 201 HL, 230 TC, 24/75, 201 R, 201 CF, 226, 201 L; 9/338, 339; 248/223, 341, 339; 16/172; 59/85; 74/250; 403/353

[56] References Cited

UNITED STATES PATENTS

| | | | |
|---|---|---|---|
| 506,494 | 10/1893 | Harrison | 24/75 |
| 736,576 | 8/1903 | Camp | 24/75 |
| 2,935,751 | 5/1960 | Emmick | 9/339 |
| 3,022,104 | 2/1962 | Shandel | 24/201 HL |
| 3,165,803 | 1/1965 | Gaylord | 24/201 HE |
| 3,462,179 | 8/1969 | Hinkle | 24/201 HL |

FOREIGN PATENTS OR APPLICATIONS

| | | | |
|---|---|---|---|
| 719,798 | 10/1965 | Canada | 24/201 HL |
| 757,700 | 12/1933 | France | 24/75 |
| 1,249,495 | 10/1971 | United Kingdom | 9/338 |

*Primary Examiner*—Bernard A. Gelak

[57] ABSTRACT

A life preserver or other body-buoying equipment is provided with straps extending from its opposite sides, and the two pieces of a buckle are fastened to the respective ends of the straps. The two pieces of the buckle can be engaged with one another and disengaged only when the pieces are swiveled toward one another at an angle of less than 90°. The invention includes the two-piece buckle itself as well as the combination of the two pieces of the buckle on the ends of the belt means extending from the sides of such body-buoying equipment.

9 Claims, 9 Drawing Figures

FIG. 7
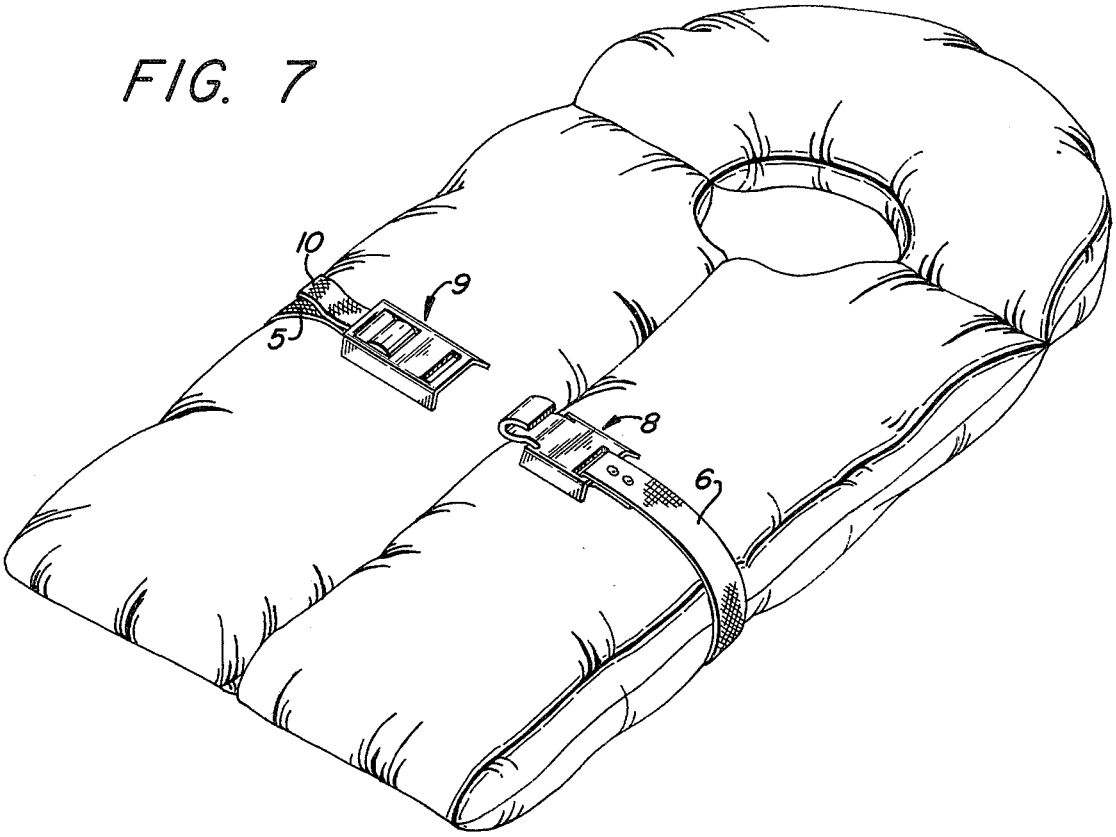
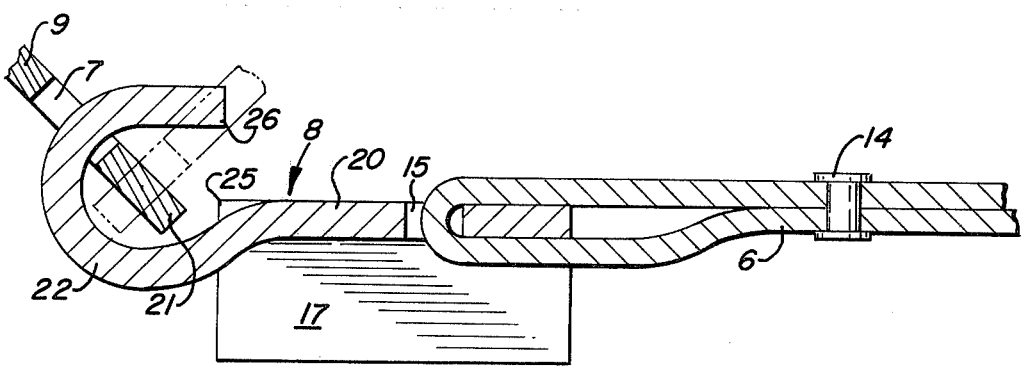
FIG. 8
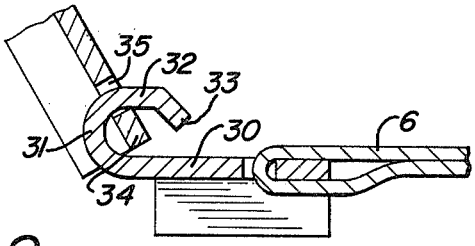
FIG. 9

TWO-PIECE BUCKLE AND ITS USE ON BODY-BUOYING EQUIPMENT

PRIOR ART

Various buckles are known, the parts of which, attached to opposite ends of a belt, must be held at a substantial angle to one another to permit engagement and disengagement, but these buckles do not comprise two pieces, namely, one piece with a hook thereon and the other with a slot therein for engagement by the hook, as disclosed herein. Such art includes the following patents:

Fries U.S. Pat. No. 198,073, Katzenmeyer U.S. Pat. No. 944,788, Hurlbutt U.S. Pat. No. 1,487,387, Groh U.S. Pat. No. 1,840,896, Sander et al. U.S. Pat No. 3,739,432.

Chamberlain U.S. Pat. No. 2,898,610 discloses a two-piece buckle on a swimming buoy. The two pieces can be engaged and disengaged only when they are twisted with respect to one another, and not when they are swiveled about a line parallel to the juncture of the two pieces to an angle of less than 90°, as disclosed herein. The necessity for swiveling the parts prevents unintentional disengagement of the two pieces, and the buckle of this invention permits ready disengagement of the two pieces in an emergency.

THE INVENTION

The invention relates to a two-piece buckle designed particularly for use on the two ends of a strap or other belt means to be used by a person in fastening to himself a life preserver or jacket or swimming aids including water wings, or any other buoyant equipment used on a human body, the unintentional disengagement of which may jeopardize the wearer's life, and the quick disengagement of which is possible when necessary. The invention includes the buckle as well as body-buoying equipment provided with the buckle.

The two pieces of the buckle are fastened to opposite ends of a strap or other belt means which is designed to encircle the wearer's trunk. To prevent unintentional disengagement of the two pieces of the buckle, they must be swiveled about an axis parallel to the juncture of the two pieces of the buckle to an angle of less than 90° and preferably to an angle of substantially 45° to be disengaged. The two pieces of the buckle can be quickly disengaged when brought to this angle.

In a preferred form of the buckle of the invention, one piece of the buckle (herein referred to as the hook piece), comprises a base with a hook-shaped extension extending from one end thereof which is to be engaged in a relatively narrow crosswise slot in the other piece of the buckle (herein referred to as the slot piece). The mouth of the hook faces over the base in a direction substantially parallel to the face of the base.

Both pieces of the buckle are preferably rigid and the effective portions of both pieces are substantially flat. The lateral edges of one or both pieces may be bent inward to make the buckle more attractive by spacing the effective portion thereof from the body of the person wearing the buckle. By spacing the slot portion from the body it is more easily engaged with, and disengaged from the hook.

The opening into the hook widens from the mouth inward. A strap extends from the end of the hook piece which is opposite the hook. It is preferably threaded through a crosswise slot and the end of the strap may be folded back and fastened to itself.

The slot piece includes a crosswise slot near one of its ends, and the hook is engaged in, and disengaged from, this slot. The distance from this slot to this end of the piece is greater than the width of the mouth of the hook so that the two pieces must be swiveled toward one another to an angle of less than 90°, and generally at an angle of about 45°, in order that the end of the slot piece which is near the slot (herein referred to as the engageable portion of the slot piece), can be inserted through the mouth of the hook into its interior where the distance between the walls of the hook is greater than the engageable portion of the slot piece. When the engageable portion of the slot piece is in the interior of the hook, the two pieces can be swiveled about an axis parallel to the juncture of the two pieces so that they extend outward in opposite directions. In order to disengage the two pieces, they must be swiveled back so that they are at an angle of less than 90° to one another.

It is important that the buckle means joining the straps on a life preserver do not become unintentionally disengaged with separation of the life preserver from its wearer, possibly resulting in the drowning of the wearer. It is also important that the two pieces of the buckle may be quickly and readily intentionally disengaged when the wearer panics in the event of an emergency.

The belt means need not be continuous from one end to the other, but it may comprise two end portions fastened to opposite sides of the buoyant article, although the belt means may be continuous and be threaded through the article, or it may be fastened to it in any suitable manner.

The invention is further described in the accompanying drawings, in which

FIG. 7 shows the buckle on a life jacket;

FIG. 8 is an enlarged view of the buckle, etc. shown in FIG. 5; and

FIG. 9 is a section through a different hook and slot piece at different angles to one another.

Figure 1:
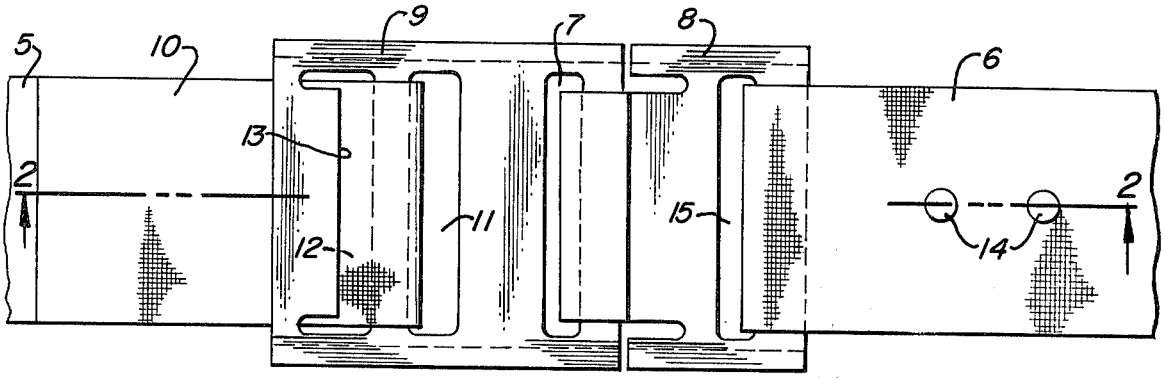
FIG. 1 is a plan view of the two ends of a belt, each of which is fastened to one of two interlocked parts of a two-piece buckle.

FIG. 1 shows the two ends 5 and 6 of the belt to which the pieces 8 and 9 of the buckle are fastened. The end 10 of the belt part 5 is woven through slot 11 and back through slot 12, with a flange 13 of the buckle bent inward, forming a projection which presses the end 10 and the belt part 5 toward the wearer of the belt to prevent slippage when the belt is in use, but allowing slippage to provide adjustment of the belt to a required length when not in use. The other opening 14 in the slot piece is too narrow to slip over the end of the hook. This will be discussed below.

The belt end 6 is threaded through opening 15, and the overlapping portions are fastened together by studs 14.

The two side edges of both parts of the buckle are bent inwardly, preferably at an angle of about 125° to form flanges 17 which space the buckle a short distance from the body of the wearer of the belt and bring the outer faces of the pieces 9 and 10 into substantially the same plane when the safety belt is being worn. The base 20 of the hook of piece 8 is bent inward at the inner end of the hook, about the thickness of the part 9 so that when the two pieces are engaged, the surfaces of the base 20 and the part 9 will be positioned in substantially the same plane when under tension.

The portion 21 of the hook is substantially parallel to the portion 20 and is offset inwardly about the thickness of the piece 9 to hold the outer face of the piece 9 in substantially the same plane as the outer face of the base 20. This is not essential that the faces of the parts be in nearly the same plane, but it adds to the appearance of the buckle when the pieces are engaged with one another.

The enlarged view in FIG. 8 shows the relation of the engageable portion 21 of the slot piece 9 and the hook piece 8 which makes it necessary to have them swiveled to an angle of less than 90° to one another in order to engage them and disengage them.

The effective width of the mouth of the hook is narrowed slightly by the points 25 on the flanges 17. The effective width of the mouth opening between the points 25 and the bottom end 26 of the outer end of the hook is less the length of the engageable portion 21 of the slot piece 9. If the flanges did not narrow the effective width of the mouth, the engageable portion 21 of the slot piece could enter the mouth at any angle. If the points 25 did not narrow the effective width of the mouth, in order to comply with the requirements of the invention the point 26 of the hook would have to be brought down to narrow the mouth. It is essential that the engageable portion 21 of the slot piece be wider than the effective width of the mouth.

Figure 2:
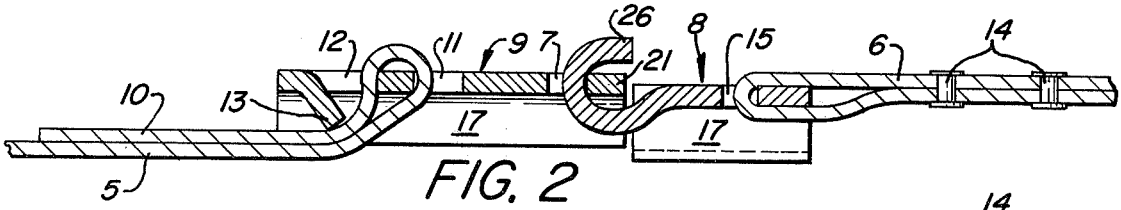
FIG. 2 is a section on the line 2—2 of FIG. 1.
Figure 3:
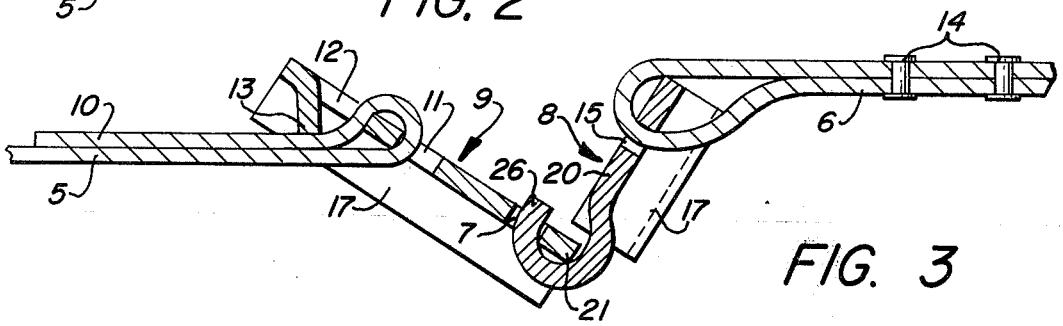
FIG. 3 is a section through the two parts of the buckle at an angle to one another as they are being engaged or disengaged.
Figure 4:
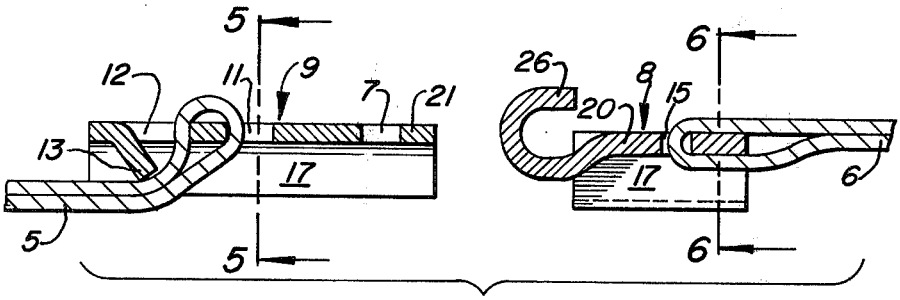
FIG. 4 is a section through the two parts of the buckle disengaged from one another.
Figure 5:
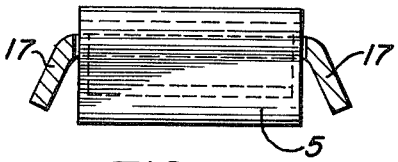
FIG. 5 is a section on the line 5—5 of FIG. 4.
Figure 6:
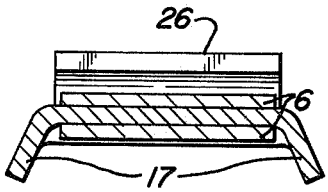
FIG. 6 is a section on the line 6—6 of FIG. 4.

It is also essential that the slot 14 be narrower than the outer surface of the turned-back end of the hook. If this were not true, i.e. if this slot 14 were wide enough to slip over the end of the hook with the two pieces of the buckle held at an angle of about 180 degrees to one another, the two pieces of the buckle could be engaged and disengaged by just lifting the slot piece 9 (as shown in FIG. 2) somewhat, and bringing the two pieces closer together, and slipping the engageable portion of the slot piece in or out of engagement with the hook.

With the slot 14 sufficiently narrow, and the engageable portion 27 sufficiently wide, and the portion of the second piece from said end throughout the area that includes the slot being substantially flat, it is necessary to hold the pieces at a proper angle, as shown in FIG. 8, to engage the enagageable portion 21 in the mouth of the hook, and to disengage it therefrom. What is a proper angle depends upon the width of the engageable portion 27 and the width of the mouth. In FIG. 8, the phantom showing of the slot piece is at an angle of about 45 degrees to the base 20 of the hook piece. If the mouth were somewhat narrower, the slot piece would have to be held at a smaller angle to the base 20 of the hook. The mouth might be somewhat wider. The width of the mouth and the length of the engageable portion of the slot piece control the angle to which the slot piece and the base 20 must be brought to provide for engagement of the hook in the slot and for disengagement of the two pieces. The angle of the two pieces might be as much as 80 degrees, but it must be less than 90 degrees, because if the engageable portion can enter the mouth at 90 degrees from the hook without being angled toward the base.

The shape of the hook is not too important, except that the entrance widens from the mouth inwardly.

FIG. 9 illustrates the modification of the hook shown in the prior drawings. Here, there is no downward bend of the base portion 30 where the hook 31 begins. Also, the end 32 of the turned-back portion of the hook slants downwardly. The perpendicular distance from the point 33 to the base 30 is less than the length of the engageable portion 34 of the slot piece. This is important because it prevents the slot piece from being brought over the end of the hook holding the slot piece at approximately the angle shown in FIG. 9. It is necessary to swivel the slot piece toward the base 30 and insert the engageable portion 34 in the mouth of the hook and then the opening 35 can be brought up around the hook so that the two pieces are at the angle shown, or the slot piece can be brought way around until it is substantially parallel with the base 30. It is not important that the slot piece be brought into the same plane as the base 30, and this is impossible with the hook shown.

I claim:

1. A two-piece buckle which includes a rigid first piece with a hook having a turned back outer end extending from a substantially flat base portion, a rigid second piece with a slot across the same for engagement by the hook, the slot being substantially straight and so spaced from the edge of the second piece that the portion of the piece between the slot and this edge, referred to herein as the engageable portion, is longer than the narrowest portion of the mouth of the hook, with the hook opening widening inwardly from the mouth to a width greater than the width of said engageable portion and the entire portion of the second piece being substantially flat from said end throughout the area that includes the slot so that said engageable portion must be at an angle of less than 90° to said base in order for the slot to become engaged by the hook and disengaged therefrom; the slot being so narrow that when the pieces are substantially parallel, it is not long enough to fit over the turned-back outer end of the hook.

2. The buckle of claim 1 in which said pieces must be at an angle of substantially 45° to each other for the hook to become engaged in the slot and disengaged therefrom.

3. The buckle of claim 1 in which the hook is offset inwardly from the base of the first piece by substantially the thickness of the second piece so that when the two pieces are engaged and pulled in opposite directions, the outer surface of the second piece lies in substantially the same plane as the base.

4. The buckle of claim 1 in which the second piece is substantially flat from one end to the other.

5. The ends of two belt-means extending oppositely from human-body buoying means, having at one of the ends a first piece of a two-piece buckle with a hook extending rigidly therefrom and at the other end a second piece of the buckle with a substantially straight slot therein which extends width-wise of the plate, said hook having a turned back outer end extending from a substantially flat base portion, said end extending from a substantially flat base portion, said slot being substantially straight and so spaced from the edge of the second piece that the portion of the piece between the slot and this edge, referred to herein as the engageable portion, is longer than the narrowest portion of the mouth of the hook, with the hook opening widening inwardly from the mouth to a width greater than the width of said engageable portion and the entire portion of the second piece being substantially flat from said end throughout the area that includes the slot, the hook being engageable in the slot and disengageable therefrom only when the plates are rotated about a line substantially parallel to the slot to an angle of less than 90° to one another, the two pieces being substantially parallel to one another when the hook is engaged in the slot and the ends of the belt means are taut, the slot being so narrow that when the pieces are substantially parallel, it is not long enough to fit over the turned-back outer end of the hook.

6. The combination of claim 5 in which the hook is engageable in the slot and disengageable therefrom only when the plates are at an angle of less than substantially 45°.

7. The combination of claim 5 in which the buoying means is a life preserver.

8. The combination of claim 5 in which said portions of the pieces must be at an angle of less than substantially 45° to each other for the engageable portion to become engaged by the hook and disengaged therefrom.

9. The combination of claim 5 in which the hook is offset inwardly from the substantially flat portion of the first piece by substantially the thickness of the second piece so that when the hook is engaged in the slot and the two pieces are pulled in opposite directions, the substantially flat portions of the two pieces lie in substantially the same plate.

* * * * *

UNITED STATES PATENT OFFICE

CERTIFICATE OF CORRECTION

PATENT NO. : 4,010,501

DATED : March 8, 1977

INVENTOR(S) : Lawrence G. Cooke

It is certified that error appears in the above-identified patent and that said Letters Patent are hereby corrected as shown below:

Column 4, line 1 should read: -- the mouth at 90 degrees to the base, it can be removed from the hook without being --

Signed and Sealed this

Third Day of May 1977

[SEAL]

*Attest:*

RUTH C. MASON
*Attesting Officer*

C. MARSHALL DANN
*Commissioner of Patents and Trademarks*